US006463160B1

(12) United States Patent
Tracy

(10) Patent No.: US 6,463,160 B1
(45) Date of Patent: Oct. 8, 2002

(54) LOW PROFILE LOUDSPEAKER ASSEMBLY

(76) Inventor: Dennis A. Tracy, 11136 Washington Blvd., Culver City, CA (US) 90232

( * ) Notice: Subject to any disclaimer, the term of this patent is extended or adjusted under 35 U.S.C. 154(b) by 0 days.

(21) Appl. No.: 09/504,260

(22) Filed: Feb. 15, 2000

Related U.S. Application Data

(60) Provisional application No. 60/120,123, filed on Feb. 16, 1999, and provisional application No. 60/158,304, filed on Oct. 10, 1999.

(51) Int. Cl.[7] ..... H04R 25/00
(52) U.S. Cl. ..... 381/386; 381/332
(58) Field of Search ..... 381/86, 87, 332, 381/386, 389, 431; 181/199

(56) References Cited

U.S. PATENT DOCUMENTS 4,417,170 A * 11/1983 Benincasa ..... 310/345
5,210,793 A * 5/1993 Carlson et al. ..... 379/433
5,818,950 A * 10/1998 Sakamoto et al. ..... 381/201
5,967,585 A * 10/1999 Sprague ..... 181/199
5,996,727 A * 12/1999 Blind et al. ..... 181/199

* cited by examiner

*Primary Examiner*—Sinh Tran
(74) *Attorney, Agent, or Firm*—Welsh & Flaxman LLC

(57) ABSTRACT

A low profile loudspeaker assembly is disclosed. The loudspeaker assembly includes a housing in which at least one driver is mounted. The housing includes a first aperture and a second aperture wherein the first and second apertures are on opposite sides of the housing. The driver includes a cone coupled to a driver magnet assembly for generating sound. The cone is aligned with the first aperture to permit the direct passage of sound from the loudspeaker and the driver magnet assembly is seated within the second aperture exposing a portion of the driver magnet assembly to the exterior of the housing, wherein the depth to which the driver magnet assembly sits within the second aperture facilitates a reduction in the profile of the loudspeaker.

14 Claims, 9 Drawing Sheets

LOW PROFILE LOUDSPEAKER ASSEMBLY

CROSS-REFERENCE TO RELATED APPLICATIONS

This U.S. Patent Application is based upon U.S. Provisional Patent Application Ser. No. 60/120,123, filed Feb. 16, 1999, entitled "LOW PROFILE SUBWOOFER ASSEMBLY" and No. 60/158,304, filed Oct. 10, 1999, entitled "LOW PROFILE LOUDSPEAKER ASSEMBLY".

BACKGROUND OF THE INVENTION

1. Field of the Invention

The invention relates to loudspeaker assemblies. More particularly, the present invention relates low profile loudspeaker assemblies. The loudspeaker assemblies are shaped and dimensioned for positioning within a variety of previously unused spaces found within an aircraft.

2. Description of the Prior Art

The current global community has made it possible for people from around the country, and around the world, to interact for both business and personal reasons. For many people, this requires that they spend considerable time traveling from one location to another location. More often than not, these people travel in aircraft.

Whether these people travel in private or commercial aircraft, they desire high quality entertainment during the many hours they spend within the confines of an aircraft. However, while high quality entertainment, for example, digital video with CD quality sound, is readily available for theater and home use, the weight and size requirements for use in aircraft make it very difficult to incorporate high fidelity systems within an aircraft. This problem is especially pronounced for audio speaker assemblies when one attempts to meet the size, weight and shape requirements for use in aircraft.

In the aircraft industry great priority is placed upon component weight and size reduction. In addition, spacing and positioning of the speaker assemblies is a great priority to those optimizing the operation of aircraft. The size, weight and shape of conventional terrestrial speaker assembly designs adversely affect range and payload. These concerns are notable when one attempts to make changes within smaller private jets. For example, a small increase in the weight carried by an aircraft results in a substantial increase in the fuel consumption of the aircraft. In addition, the limited space available within an aircraft dictates the use of any space within the aircraft be carefully considered by those responsible for ensuring the comfort of passengers.

Lightweight and compact audio speakers are currently available. These speakers, however, substantially compromise sound quality for reductions in size and weight. An individual wishing to add an audio system to an aircraft must make a choice between high fidelity speakers not suiting the size and weight requirements of the aircraft and lower quality speakers providing desirable size and weight characteristics.

A need, therefore, exists for a speaker assembly providing high fidelity sound, while also meeting the size and weight requirements of an aircraft. The present invention provides such a speaker assembly.

SUMMARY OF THE INVENTION

It is, therefore, an object of the present invention to provide a low profile loudspeaker assembly. The loudspeaker assembly includes a housing in which at least one driver is mounted. The housing includes a first aperture and a second aperture wherein the first and second apertures are on opposite sides of the housing. The driver includes a cone coupled to a driver magnet for generating sound. The cone is aligned with the first aperture to permit the direct passage of sound from the loudspeaker and the driver magnet is seated within the second aperture exposing a portion of the driver magnet to the exterior of the housing, wherein the depth to which the driver magnet sits within the second aperture facilitates a reduction in the profile of the loudspeaker.

It is a further object of the present invention to provide a seat assembly including a seat and the loudspeaker assembly described above secured beneath the seat.

It is another object of the present invention to provide a loudspeaker assembly including a housing in which at least a first driver is mounted, the housing including a first wall and a second wall opposite the first wall. The first driver is compression fit between the first wall and the second wall.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
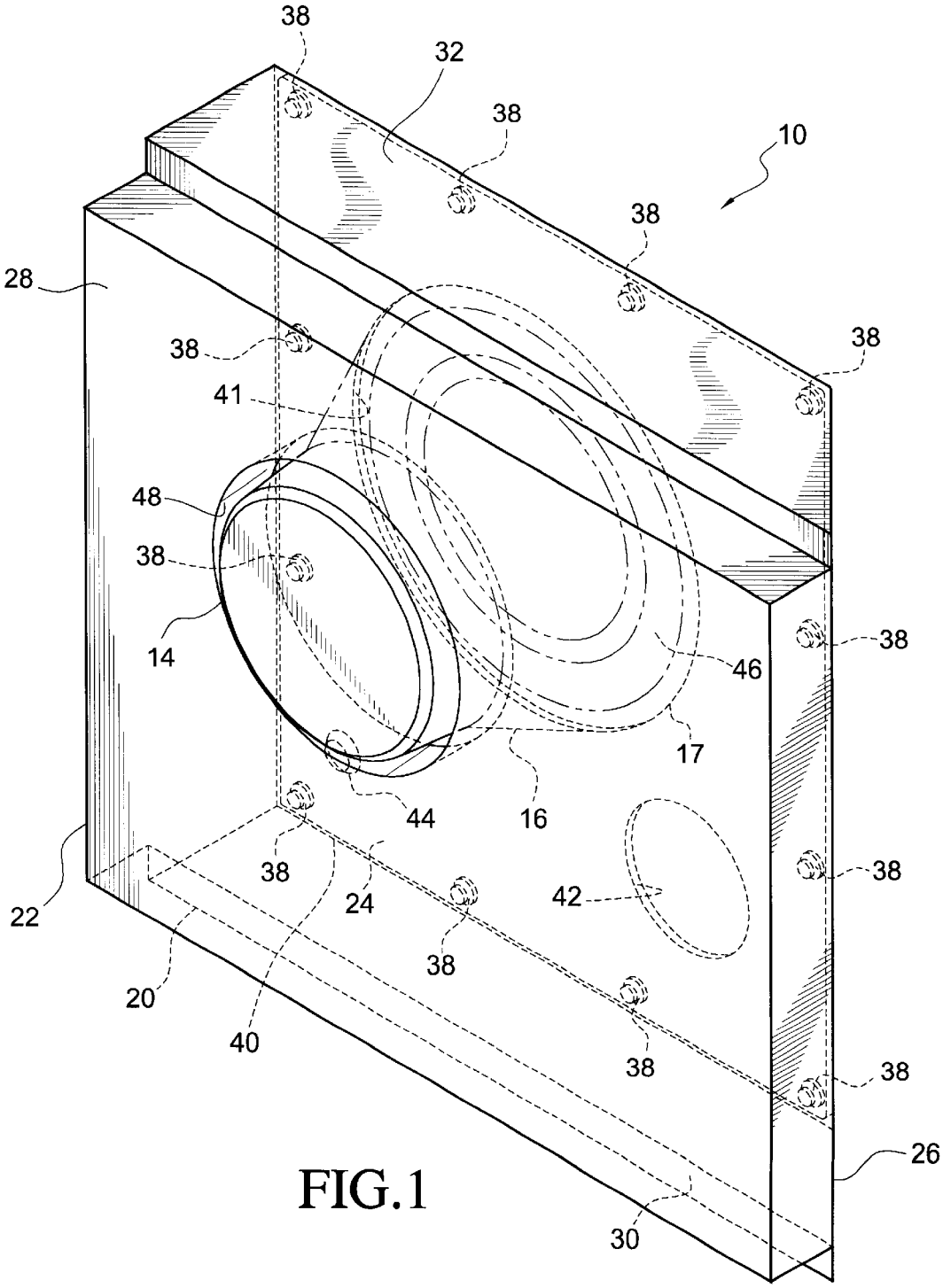
FIG. 1 is a perspective view of the present subwoofer with the internal components shown in phantom.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 through 6, a low profile loudspeaker assembly, more specifically, a subwoofer 10, is disclosed. The subwoofer 10 is designed for positioning beneath an aircraft seat 12. In accordance with the preferred embodiment of the present invention, the subwoofer 10 has been designed for mounting beneath a 16 G AMP aircraft seat, although the present subwoofer may be used in conjunction with other seats without departing from the spirit of the present invention. The need for the lower profile, discussed below in greater detail, is necessitated by the limited clearance between the base of the 16 G AMP aircraft seat and the floor.

Given that the present subwoofer 10 was designed for positioning beneath an AMP aircraft seat, the subwoofer 10 incorporates a unique design which reduces the profile of the subwoofer 10 without sacrificing sound quality. The reduced profile is achieved by positioning the driver magnet assembly 14 of the driver 16 within the honeycomb walls of the housing 20. In this way, space that would have simply been occupied by the bottom wall 22 of the subwoofer housing 20 is used in an effective manner to store a portion of the driver magnet assembly 14. In addition, a slight portion of the driver magnet assembly 14 extends below the housing 20. This also contributes to the reduction of the subwoofer profile. This improvement in the use of space is critical to fitting the present subwoofer 10 within the allowable space available under the AMP aircraft seat 12.

By cutting away a portion of the bottom wall 22 of the housing 20, the weight of the housing 20 is also reduced (for example, by about 3.2 ounces). While such a reduction in weight appears to be minor, any weight reduction within an aircraft is considered to be a substantial benefit.

Specifically, and with reference to FIGS. 1 and 3–6, the subwoofer 10 includes a housing 20 having a top wall 24, a bottom wall 22, a front wall 26, a rear wall 28 and side walls 30, 32. As briefly discussed above, the housing 20 is preferably manufactured from honeycombed aluminum, and as such includes an interior wall 50, a honeycomb center 52, and an exterior wall 54.

The side walls 30, 32 include indented sections 34, 36. As such, the distance between the side walls decreases as the housing 20 extends from the top wall 24 to the bottom wall 22. The indented sections 34, 36 allow for the positioning of the subwoofer 10 beneath the AMP aircraft seat 12. The top wall 24 of the housing 20 is formed separately from the remainder of the housing, and is secured to inwardly extending ledges 40 formed along the front wall 26, rear wall 28 and side walls 30, 32 of the housing 20. Screws 38 securely attach the top wall 24 to the remainder of the housing.

The top wall 24 includes a primary aperture 41, a sound port 42 and a grommet aperture 44. The primary aperture 41 is aligned with the cone 46 of the driver 16 and permits the direct passage of sound from the subwoofer 10. The top edge 17 of the driver 16 is secured to the interior of the top wall 24 adjacent the primary aperture 41. As such, the driver 16 is securely mounted between the top wall 24 and the bottom wall 22 in a manner that will be discussed below in greater detail. The sound port 42 allows for the indirect passage of sound from the driver 16 to increase the efficiency of the present subwoofer 10. The grommet aperture 44 is shaped and dimensioned for the passage of wires within the housing 20.

Figure 4:
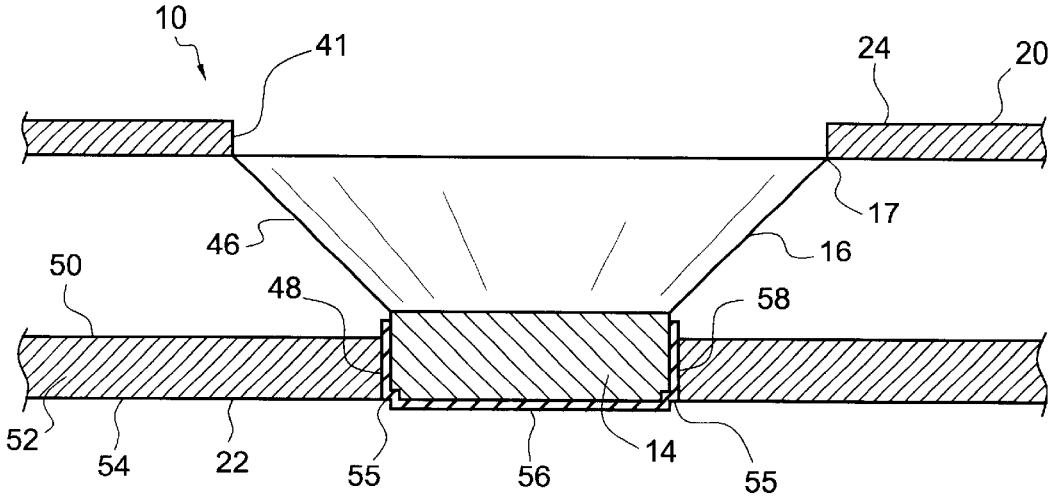
FIG. 4 is a cross sectional view taken along the line IV—IV in FIG. 3.
Figure 5:
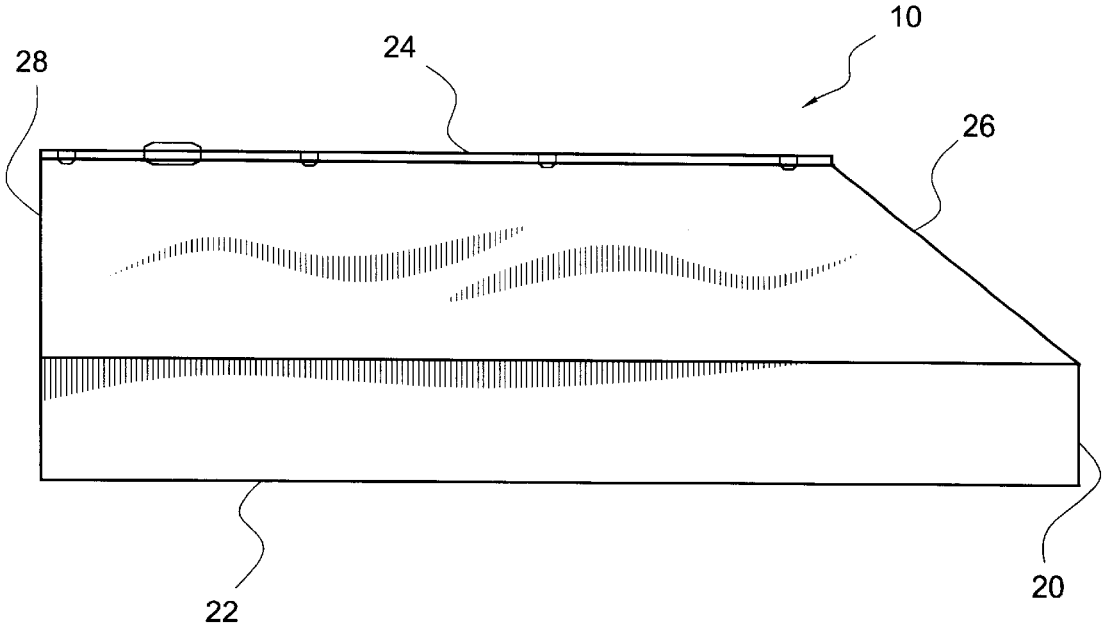
FIG. 5 is a side view of the present subwoofer.
Figure 6:
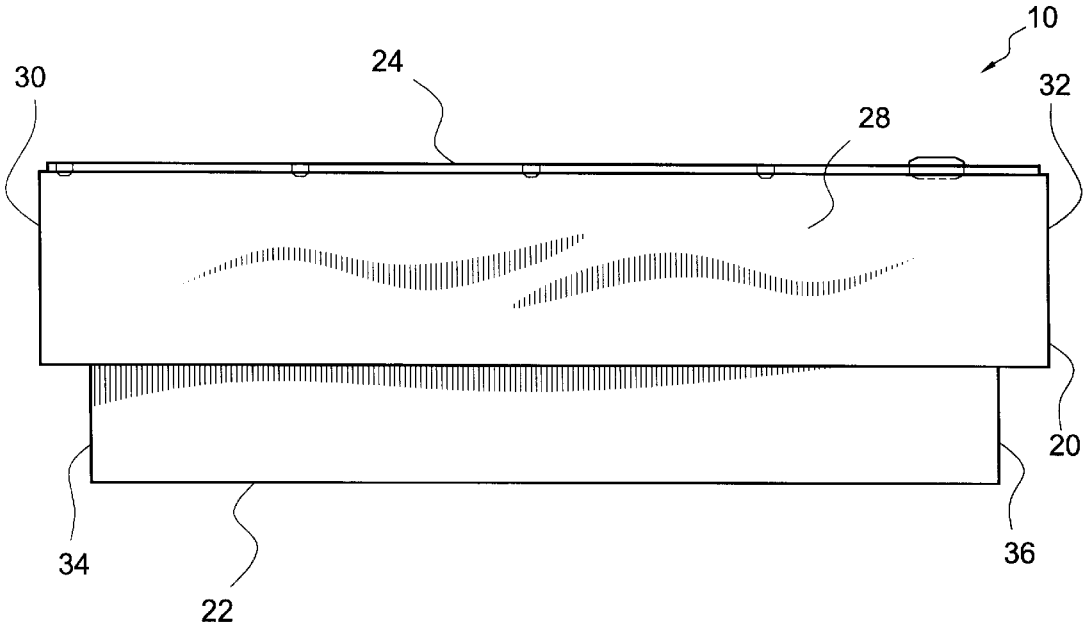
FIG. 6 is a rear view of the present subwoofer.

A driver aperture 48 is formed in the bottom wall 22 of the housing 20. As shown in FIGS. 1 and 4, the driver magnet assembly 14 of the driver 16 is seated within the driver aperture 48. Specifically, the bottom wall 22 of the housing 20 is cut open such that the interior wall 50 and the honeycomb center 52 are flush. The exterior wall 54 is cut such that it provides a slightly smaller opening than the remainder of the aperture. In this way, the exterior wall 54 forms a ledge 55 upon which the driver magnet assembly 14 is seated.

The driver magnet assembly 14 sits within the space defined by aperture 48 formed by the interior wall 50 and the honeycomb center 52. The ledge 55 supports the driver magnet assembly 14 such that the driver magnet assembly 14 is seated within the driver aperture 48 to a depth which reduces the profile of the subwoofer 10 sufficiently to facilitate placement beneath the aircraft seat 12.

The driver magnet assembly 14 of the driver 16 is wrapped in nonflammable foam 56 and is compression fit within the driver aperture 48 to essentially become part of the subwoofer housing 20. In addition to allowing for the compression fit of the driver magnet assembly 14 within the driver aperture 48, the foam 56 also prevents rattling of components within the subwoofer 10. While the driver 16 is compression fit in accordance with the preferred embodiment of the present invention, other coupling techniques may be used in securing the driver within the driver aperture 48 without departing from the spirit of the present invention.

By positioning the driver magnet assembly 14 within the bottom wall 22 of the housing 20 approximately an additional ¼ inch is saved in the profile of the subwoofer 10. This provides critical additional space for reducing the profile of the present subwoofer 10. While specific dimensions are disclosed for the present embodiment, the concepts surrounding the present invention may be applied in various applications without departing from the spirit of the present invention.

The subwoofer 10 is assembled in the following manner. The edge 58 of the driver aperture 48 is first treated with epoxy. The driver magnet assembly 14 is then wrapped in foam 56 and compression fit within the driver aperture 48. The driver 16 is then wired. The top wall 24 is secured to the remainder of the housing 20, securely fitting the driver 16 between the top wall 24 and the bottom wall 22. The subwoofer 10 is then prepared for attachment under the aircraft seat 12.

Figure 2:
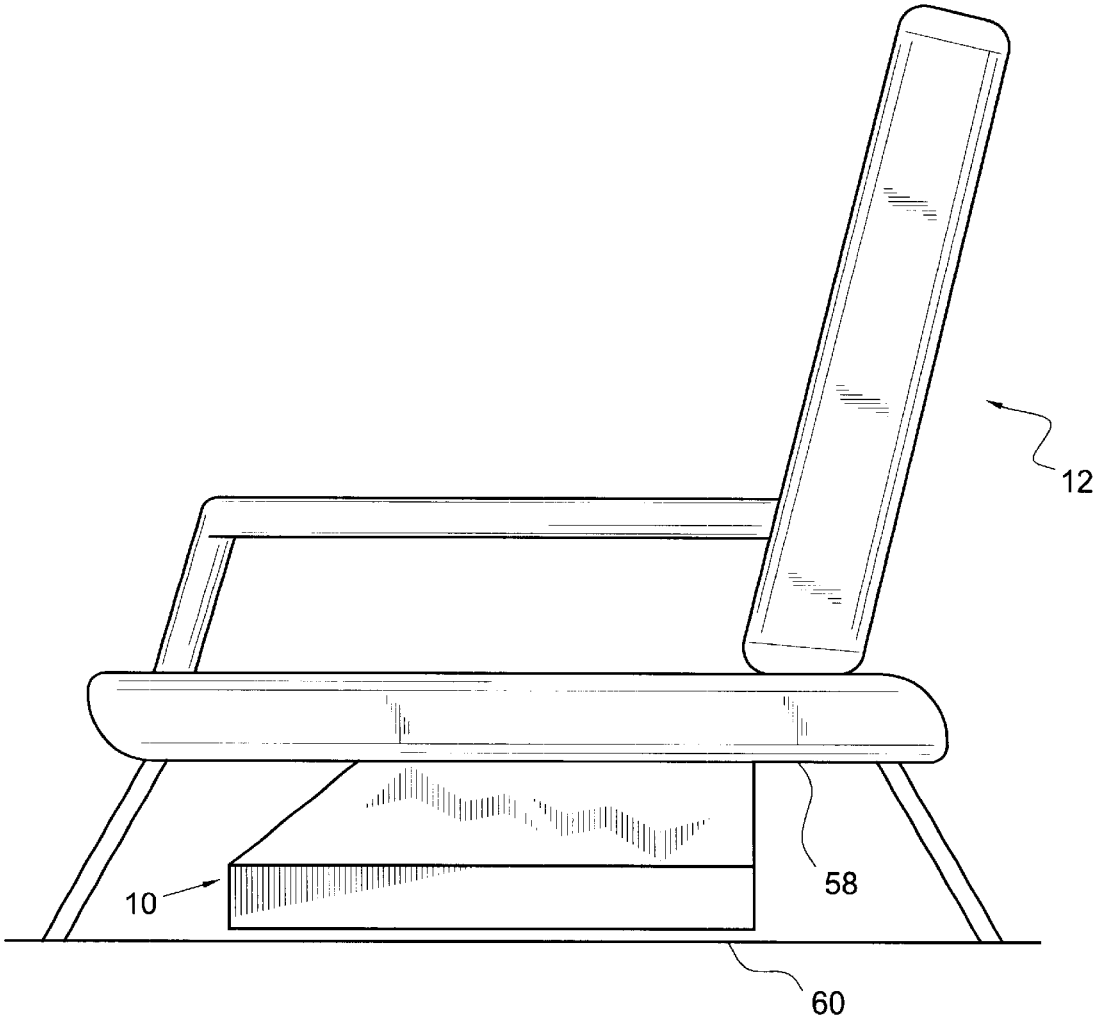
FIG. 2 is a side view of a seat with the present subwoofer secured thereto.
Figure 3:
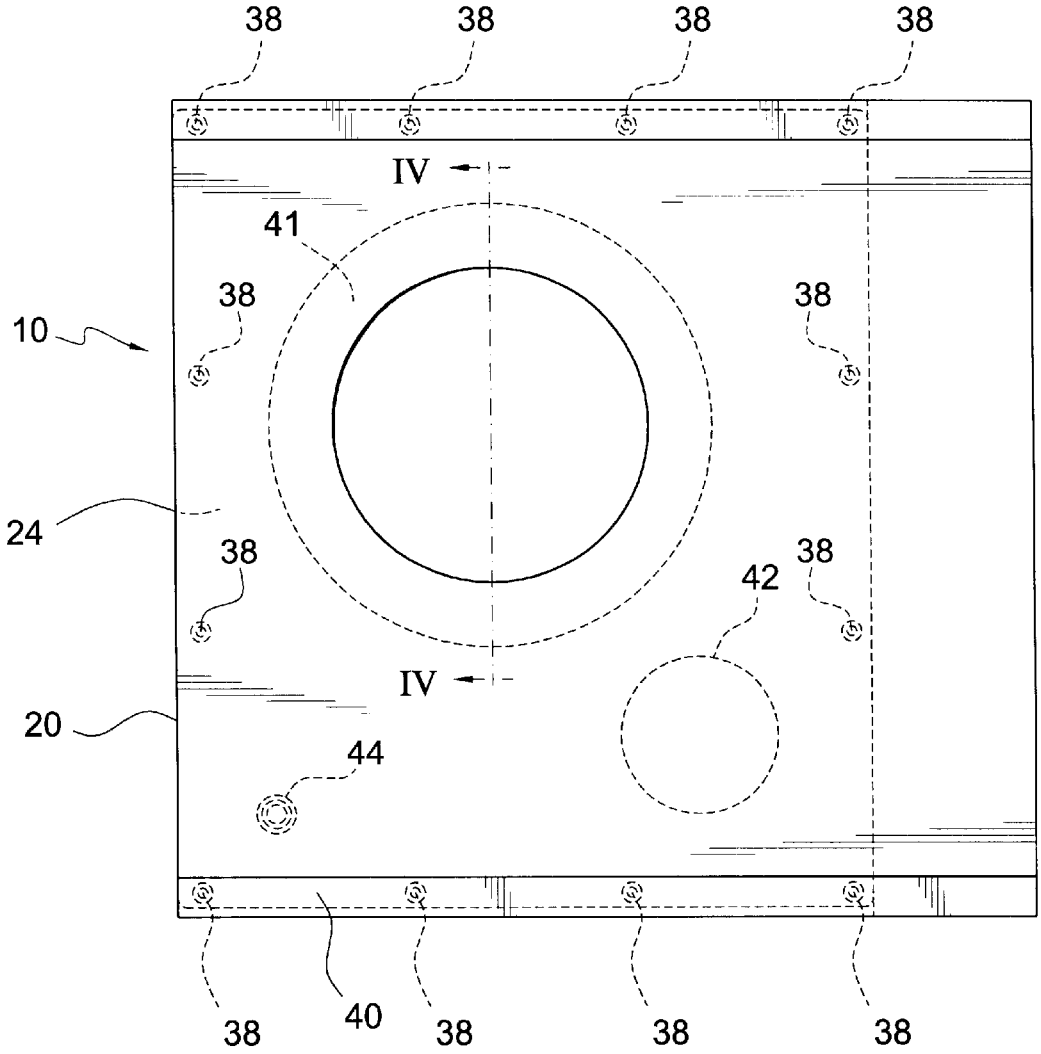
FIG. 3 is a top view of the present subwoofer.

With reference to FIG. 2, the subwoofer 10 is mounted beneath an aircraft seat 12 such that top wall 24 faces the bottom 58 of the seat 12, while the bottom wall 22 faces the floor 60 upon which the seat 12 is mounted. The space in which the subwoofer 10 must be positioned is very small and the space savings based upon the reduced profile allows for use of the small space between the seat 12 and the floor 60.

In addition to reducing the profile of the subwoofer, the present design improves the structural integrity of the subwoofer. By compression fitting the driver magnet within the drive aperture as discussed above, the driver becomes part of the internal bracing of the housing and adds to the structural stability of the subwoofer. The present design also provides a natural heat sink for cooling the driver. Specifically, the driver magnet is exposed to the interior of the aircraft, which acts as a heat sink for cooling the driver.

The resulting subwoofer has a length of approximately 11.3862 inches, a width of approximately 10.625 inches and a depth of approximately 3.0650 inches. Other dimensions are noted in FIGS. 3, 5 and 6.

In practice, multiple subwoofers are commonly mounted within an aircraft. The number of subwoofers employed is determined by the size of the aircraft and the needs of the aircraft owners. Those of ordinary skill in the art will certainly appreciate the need for specific positioning of the subwoofers within the aircraft to optimize the generated sound.

Figure 7:
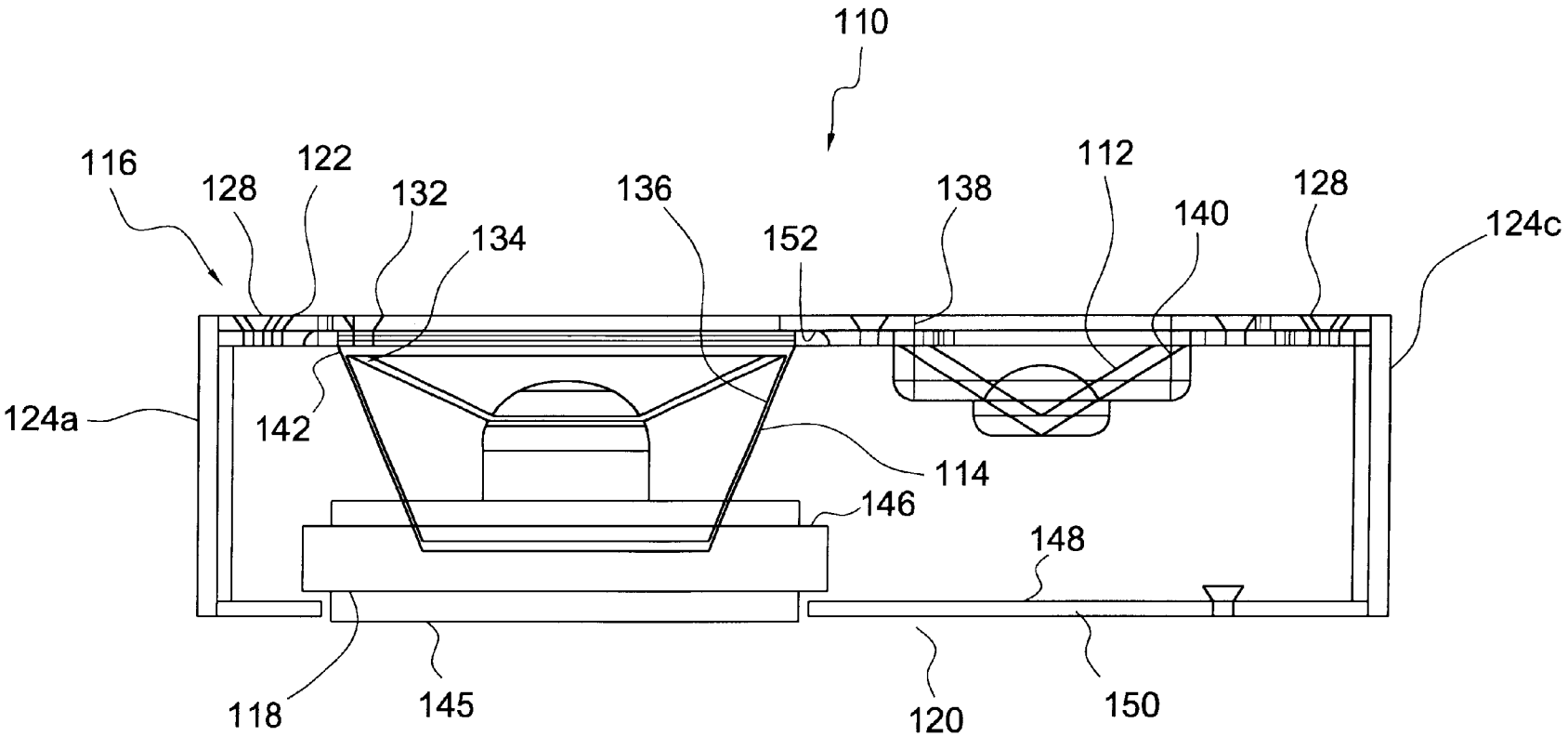
FIG. 7 is a cross-sectional view of another embodiment of the present loudspeaker assembly.
Figure 8:
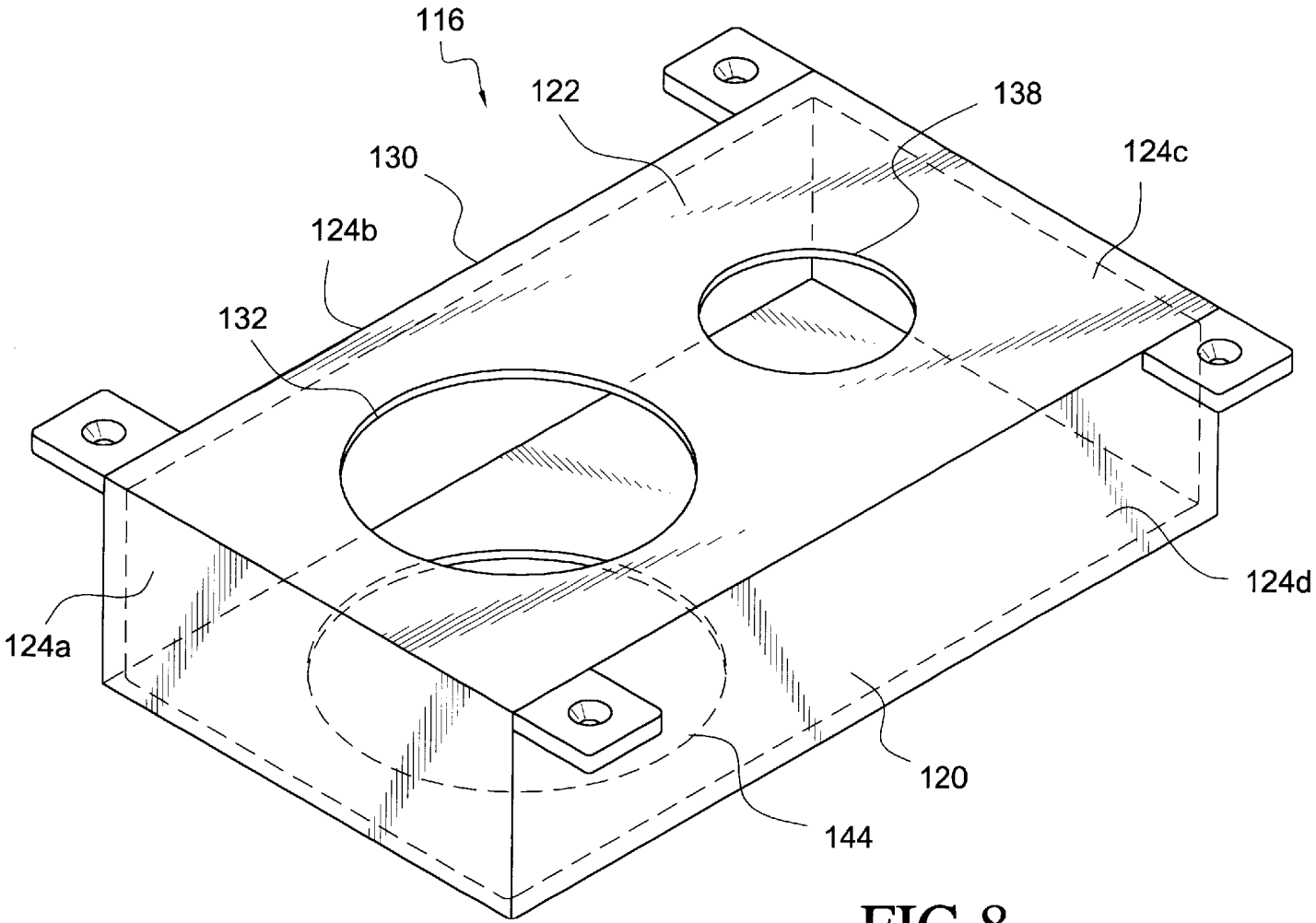
FIG. 8 is a perspective view of the housing of the loudspeaker assembly shown in FIG. 7.
Figure 9:
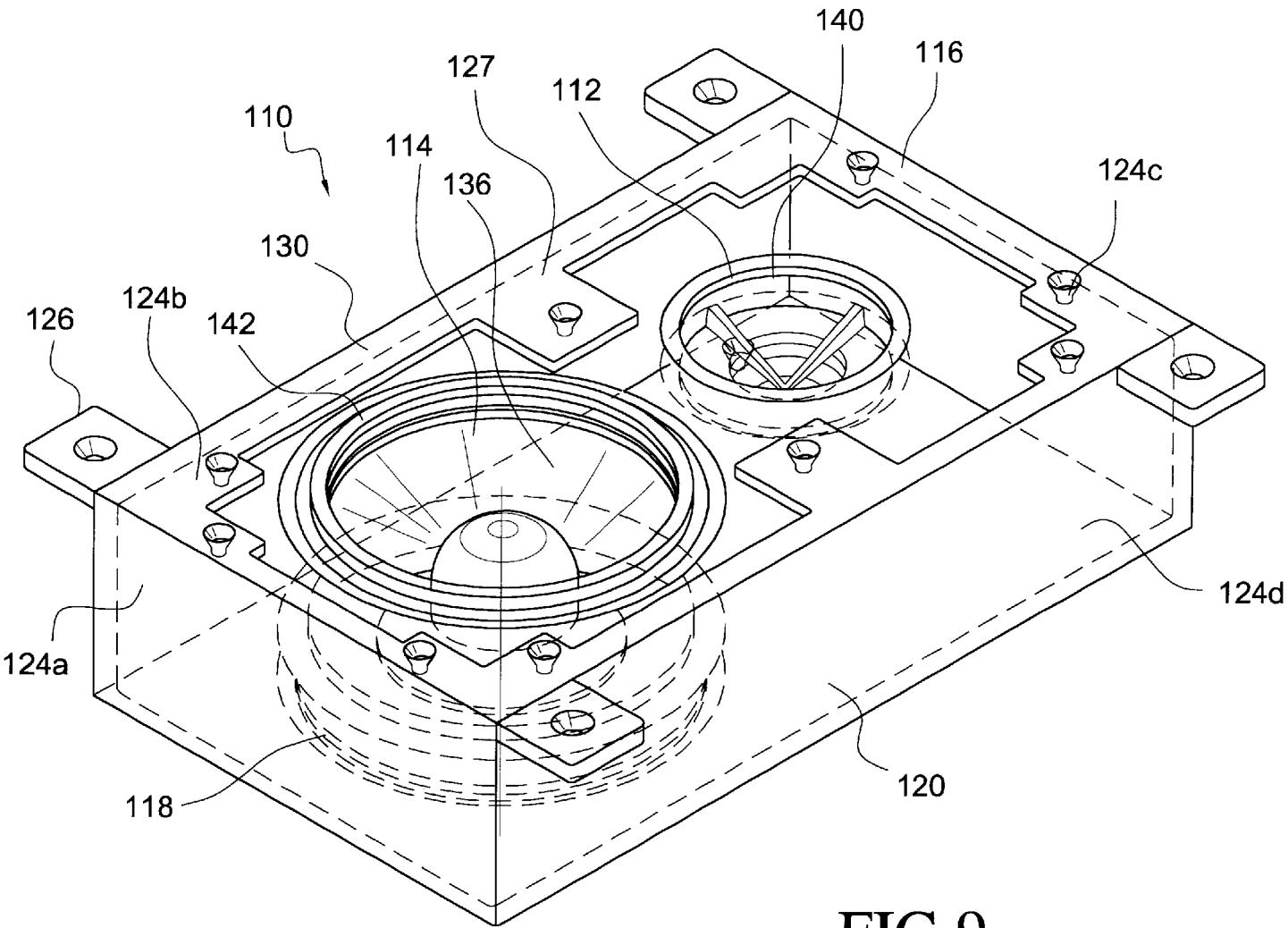
FIG. 9 is a perspective view of the loudspeaker assembly shown in FIG. 7 with the top wall removed.

With reference to FIGS. 7 through 9, a loudspeaker assembly 110 in accordance with the present invention is disclosed. The loudspeaker assembly 110 is designed for positioning within small unused cavities found within the body of an aircraft. In accordance with a preferred embodiment of the present invention, the loudspeaker assembly 110 is designed for mounting within the side wall passenger service unit of newly developing jets. However, those skilled in the art will readily appreciate that the size and weight of the present loudspeaker assembly 110 make possible a wide variety of possible mounting positions within the body of an aircraft.

The present loudspeaker assembly incorporates a high frequency driver 112, a microwoofer 114, i.e., a lower frequency driver or low frequency midrange, and crossover network (not shown) within a very compact housing 116. While the present loudspeaker assembly 110 provides a wide range of sounds, the loudspeaker assembly 110 may be supplemented by the addition of one, or more, subwoofers positioned at various locations within the aircraft.

The size, shape and weight of the loudspeaker assembly 110 are minimized by implementing a variety of unique design techniques. Briefly, the loudspeaker assembly 110 positions the microwoofer magnet assembly 118 within the bottom wall 120 of the housing 116 to lower the profile, and reduce the weight, of the loudspeaker assembly 110, compression fits the microwoofer 114 within the housing 116 to reduce weight, improve sound characteristics and add to the overall structural stability of the loudspeaker assembly 110, and utilizes a microwoofer 114 to ultimately reduce the size and weight of the loudspeaker assembly 110.

In addition, by reducing the size of the loudspeaker assembly 110 in the manner discussed above, the mass of the loudspeaker assembly 110 is reduced, and the gauge of the structural components, i.e., the screws, pins, etc., employed in the fabrication of the present loudspeaker assembly are also reduced. This results in further weight savings critical to the overall usefulness of the loudspeaker assembly 110.

With the foregoing in mind, and with reference to FIGS. 7 and 8, the loudspeaker assembly 110 includes a housing 116 having a top wall 122, a bottom wall 120, and four side walls 124*a–d*. The housing 116 is preferably manufactured from aluminum, although other lightweight, structurally rigid materials may be used without departing from the spirit of the present invention. The side walls 124*a–d* are formed with outwardly extending mounting flanges 126 used in coupling the present loudspeaker assembly 110 at predetermined locations with the body of the aircraft.

The top wall 122 of the housing 116 is formed separately from the remainder of the housing 116, and is screwed to the inwardly extending mounting flanges 127 respectively formed along the top edges 130 of the side walls 124*a–d* of the housing 116. The top wall 122 includes a primary aperture 132 shaped and dimensioned to be slightly smaller than the open end 134 of the microwoofer cone 136 and a secondary aperture 138 shaped and dimensioned to receive the open end 140 of the high frequency driver 112 cone. The high frequency driver 112 is adhesively bound to the top wall 122 adjacent the secondary aperture 138 in a conventional manner.

The primary aperture 132 is aligned with the microwoofer cone 136 and permits the direct passage of sound from the microwoofer 114. The top edge 142 of the microwoofer cone 136 engages the top wall 122 adjacent the primary aperture 132. As such, the microwoofer 114 is securely mounted between the top wall 122 and the bottom wall 120 in a manner that will be discussed below in greater detail.

A driver aperture 144 is formed in the bottom wall 120 of the housing 116. As shown in FIGS. 7 and 9, the microwoofer magnet assembly 118 is seated within the driver aperture 144. Specifically, the bottom wall 120 of the housing 116 is cut open to form the driver aperture 144. The driver aperture 144 is shaped and dimensioned to receive the smaller diameter bottom section 145 of the microwoofer magnet assembly 118 while permitting the wide portion 146 of the microwoofer magnet assembly 118 to sit upon the interior surface 148 of the bottom wall 120. The microwoofer magnet assembly 118 sits within the driver aperture 144 such that it is substantially flush with the exterior surface 150 of the bottom wall 120.

The microwoofer magnet assembly 118 is wrapped in nonflammable foam (not shown) and is compression fit with the driver aperture 144 to essentially become part of the housing 116. In addition to allowing for the compression fit of the microwoofer magnet assembly 118 within the driver aperture 144, the foam also prevents rattling of components within the present loudspeaker assembly 110. While the microwoofer 114 is compression fit in accordance with the preferred embodiment of the present invention, other coupling techniques may be used in securing the microwoofer 114 within the driver aperture 144 without departing from the spirit of the present invention.

By positioning the microwoofer magnet assembly 118 within the bottom wall of the housing, valuable space is saved in the profile of the loudspeaker assembly 110. This provides critical additional space for reducing the profile of the loudspeaker assembly 110 in accordance with the present invention.

By forming the top wall 122 separately from the remainder of the housing 116, the top wall 122 may be secured to the remainder of the housing 116 in such a manner that the microwoofer 114 is compression fit between the bottom wall 120 and the top wall 122. Specifically, the microwoofer 114 is shaped and dimensioned to exactly fit between the top wall 122 and the bottom wall 120 of the housing 116, with the microwoofer magnet assembly 118 sitting within the driver aperture 144 formed in the bottom wall 120 of the housing 116.

As a result, when the top wall 122 is screwed onto the remainder of the housing 116, with the microwoofer 114 sitting within the driver aperture 144, the inner surface 152 of the top wall 122 adjacent the primary aperture 132 presses against the top edge 142 of the microwoofer cone 136 to securely trap the microwoofer 114 between the top wall 122 and the bottom wall 120 of the housing 116.

The compression fit of the microwoofer 114 between the top wall 122 and the bottom wall 120 achieves a weight reduction in that no screws or brackets are required for the mounting of the microwoofer 114. The top and bottom walls 122, 120 act as the mounting bracket for the microwoofer 114, thereby, obviating the need for screws and other mounting structures.

In addition to reducing the profile of the present loudspeaker assembly 110, the present design improves the structural integrity of the loudspeaker assembly 110. By compression fitting the microwoofer magnet assembly 118 within the driver aperture 144 and microwoofer 114 between the top wall 122 and the bottom wall 120 as discussed above, the microwoofer 114 becomes part of the internal bracing of the housing 116 and adds to the structural stability of the loudspeaker assembly 110. As discussed with reference to the prior embodiment, the present design also provides a natural heat sink for cooling the microwoofer.

The resulting subwoofer housing has a length of approximately 4.50, a width of approximately 2.5 inches and a depth of approximately 1.12 inches. Other dimensions are noted in FIGS. 7 through 9. In addition to providing a small profile housing which fits many previously unused spaces within an aircraft, the weight of the fully assembled loudspeaker assembly 110 is approximately 10 to 11 ounces, with the microwoofer 114 weighing approximately 4.4 ounces. While specific dimensions are disclosed for the present embodiment, the concepts surrounding the present invention may be applied without departing from the spirit of the present invention.

The disclosed size of the present speaker assembly is critical to its use in newly developing aircraft. Specifically, as fuselages are being streamlined to improve the overall efficiency of the aircraft, the passenger compartment is also being moved outwardly. As a result, the space available for mounting supplemental equipment within an aircraft in a manner that does not intrude upon the available space within the passenger compartment is quickly being reduced as the aircraft are being designed more and more efficiently. At the present time, that available window dictates that at most a 2 inch depth is available for the placement of supplemental equipment such as the present loudspeaker assembly. With this in mind, the adept use of space employed in the present loudspeaker assembly results a speaker offering previously unheard of sound in a speaker assembly with a depth profile of less than 2 inches.

The present loudspeaker assemblies will be mounted within the aircraft at various locations. The number of speaker assemblies, as well as the exact location of the speaker assemblies is determined by the size of the aircraft and the needs of the aircraft owners. Those of ordinary skill in the art will certainly appreciate the need for specific positioning of the subwoofers within the aircraft to optimize the generated sound. In addition, and as discussed above, the sound generated by presented loudspeaker assembly may be supplemented by the addition of one, or more, subwoofers positioned at various locations within the aircraft.

While the preferred embodiments have been shown and described, it will be understood that there is no intent to limit the invention by such disclosure, but rather, it is intended to cover all modifications and alternate constructions falling within the spirit and scope of the invention as defined in the appended claims.

What is claimed is:

1. A low profile loudspeaker assembly, comprising:

a rigid, structurally stable and self supporting housing within which at least a first driver is mounted and enclosed, the housing including a first aperture formed in a first wall of the housing and a second aperture formed in a second wall of the housing wherein the first and second apertures are on opposite sides of the housing;

the first driver including a cone coupled to a driver magnet for generating sound, wherein the cone is aligned with the first aperture to permit the direct passage of sound from the loudspeaker and the driver magnet assembly is seated within the second aperture exposing a portion of the driver magnet to the exterior of the housing wherein the depth to which the driver magnet assembly sits within the second aperture facilitates a reduction in the profile of the loudspeaker; and the first driver is compression fit between the first wall and the second wall such that a top edge of the first driver contacts an inner surface of the first wall and a bottom edge of the first driver contacts the second wall with a compressive force being applied to the first driver by the first wall and the second wall between which the first driver is positioned, and wherein the first driver becomes part of the internal bracing of the housing adding to the structural stability of the loudspeaker assembly.

2. The loudspeaker assembly according to claim 1, wherein the first aperture and the second aperture are axially aligned.

3. The loudspeaker assembly according to claim 1, wherein the first aperture is larger than the second aperture.

4. The loudspeaker assembly according to claim 1, wherein the first driver is a subwoofer.

5. The loudspeaker assembly according to claim 1, wherein the second aperture is formed slightly larger than the driver magnet assembly and wherein the second wall includes an interior wall and an exterior wall, and the interior wall is shaped and dimensioned to allow the driver magnet assembly to pass therethrough, while the exterior wall is cut to be slightly smaller than the driver magnet assembly thereby forming a ledge upon which the driver magnet sits when mounted within the housing.

6. The loudspeaker assembly according to claim 1, further including means for attachment beneath an aircraft seat.

7. The loudspeaker assembly according to claim 1, wherein the first driver is a microwoofer.

8. The loudspeaker assembly according to claim 1, wherein the housing includes a third aperture in which a second driver is mounted.

9. The loudspeaker assembly according to claim 8, wherein the first driver is a microwoofer and the second driver is a high frequency driver.

10. An aircraft seat assembly, comprising:

a seat;

a loudspeaker secured beneath the seat, loudspeaker including:

a rigid, structurally stable and self supporting housing within which at least a first driver is mounted and enclosed, the housing including a first aperture and a second aperture wherein the first and second apertures are on opposite sides of the housing;

the driver including a cone coupled to a driver magnet assembly for generating sound, wherein the cone is aligned with the first aperture to permit the direct passage of sound from the loudspeaker and the driver magnet assembly is seated within the second aperture exposing a portion of the driver magnet assembly to the exterior of the housing;

wherein the depth to which the driver magnet assembly seats within the second aperture facilitates a reduction in the profile of the loudspeaker.

11. The seat assembly according to claim 10, wherein the first aperture and the second aperture are axially aligned.

12. The seat assembly according to claim 10, wherein the first aperture is larger than the second aperture.

13. The seat assembly according to claim 10, wherein the driver is a subwoofer.

14. The seat assembly according to claim 10, wherein the second aperture is formed slightly larger than the driver magnet assembly, wherein the second aperture is formed in a wall of the housing and the wall includes an interior wall and an exterior wall, and the interior wall is shaped and dimensioned to allow the driver magnet assembly to pass therethrough, while the exterior wall is cut to be slightly smaller than the driver magnet assembly thereby forming a ledge upon which the driver magnet sits when mounted within the housing.

* * * * *